US005209344A

United States Patent [19]

Smith

[11] Patent Number: 5,209,344

[45] Date of Patent: May 11, 1993

[54] DEVICE FOR ARRANGING AND STORING JEWELRY

[76] Inventor: Dorothy A. Smith, 1000 S. Ocean Blvd., Pompano Beach, Fla. 33062

[21] Appl. No.: 837,577

[22] Filed: Feb. 18, 1992

Related U.S. Application Data

[63] Continuation-in-part of Ser. No. 621,057, Nov. 30, 1990, abandoned, which is a continuation-in-part of Ser. No. 518,756, May 2, 1990, abandoned.

[51] Int. Cl.[5] ..... A45C 11/04

[52] U.S. Cl. ..... 206/6.1; 206/466; 206/495; 383/39

[58] Field of Search ..... 206/6.1, 45.34, 466, 206/495, 566, 287.1; 224/901; 383/39; D3/75

[56] References Cited

U.S. PATENT DOCUMENTS

| | | | |
|---|---|---|---|
| 1,909,942 | 5/1933 | Fingerman | 383/39 X |
| 2,899,997 | 8/1959 | Rauen | 383/39 |
| 3,139,133 | 6/1964 | Spector | 383/39 X |
| 3,207,421 | 9/1965 | Hunger et al. | 383/39 X |
| 3,949,916 | 4/1976 | Yount | 224/901 X |
| 4,401,219 | 8/1983 | Mink | 206/466 X |
| 5,121,833 | 6/1992 | Lindsay et al. | 206/6.1 |

*Primary Examiner*—Bryon P. Gehman
*Attorney, Agent, or Firm*—Malin, Haley, DiMaggio & Crosby

[57] ABSTRACT

A collapsable, foldable jewelry organizer and storage device capable of being hung from a closet rod or protrusion, which renders the jewelry objects stored thereby individually visible to the user, is disclosed. The device comprises a flexible substratum having a plurality of flexible transparent or translucent pockets within which jewelry objects may be stored. The pockets may be of various sizes and may be arranged in a matrix configuration. The substratum is supported from the bottom edge of a hanger by means of the interaction of the bottom edge of the hanger with a tube extending around the bottom edge of the hanger. The tube is attached to the substratum along the top edge of the substratum allowing the device to be hung from a closet rod or similar protrusion.

14 Claims, 4 Drawing Sheets

DEVICE FOR ARRANGING AND STORING JEWELRY

This application is a continuation-in-part of application Ser. No. 07/621,057, filed Nov. 30, 1990, now abandoned, which is a continuation-in-part of application Ser. No. 518,756, filed May 2, 1990, now abandoned.

BACKGROUND OF THE INVENTION

1. Field of the Invention

This invention relates to a device for storing jewelry and in particular to a collapsable and foldable jewelry storage device which may be hung from closet rods or the like and which renders the pieces of jewelry stored in an organized array therein visible to an observer while the jewelry is being stored.

2. Description of Related Art

Devices have long existed for storage of jewelry and the like. Typically these devices consist of jewelry boxes which are rigid and manufactured of opaque material with limited segregated storage space. Typically a jewelry box has one or two tiered shelves that slide back when the top is opened exposing a larger box container where often individual pieces are stacked upon each other in a disorganized fashion. Consequently, in order for the user to see the individual pieces of jewelry, the jewelry box must be opened and individual pieces manually removed to observe all the pieces in the box. This often requires space around the boxes to allow sufficient space for the box to open a sufficient distance to see its contents. Often the tiered shelves block a portion of the ambient light making it difficult to see the contents of the box once it is opened. This is a problem in want of a solution.

In addition, due to the rigid nature of the jewelry box, the jewelry box may not be collapsed for easy transport or storage. Therefore, much space is wasted, resulting in a relatively large space being needed to store relatively small items for both home storage or travel. Consequently, travel with jewelry in a jewelry box is cumbersome. Also jewelry can be damaged if the jewelry box is exposed to baggage handlers and accelerations and compressions due to the motion of the transportation vehicle. These factors combine to render the jewelry box relatively difficult to store or transport. This is also a problem in want of a solution.

SUMMARY OF THE INVENTION

The instant invention provides a readily collapsable and foldable jewelry storage and transportation device. In addition, the individual stored jewelry items are rendered visible in an organized array to the user to aid in the selection of an appropriate piece of jewelry.

The invention comprises a flexible substratum which may be made of a quilted, padded or matted cloth material for protection of the jewelry to which flexible translucent or transparent sheets of plastic are affixed, preferably by stitching, to form pockets. Each pocket has an open upper edge for easy placement and retrieval of individual pieces of the jewelry. Pockets may be of a variety of sizes and configurations, although a matrix arrangement of the pockets has been found to be particularly effective for making the maximum use of available space and for ordering and arranging the respective items of jewelry.

The substratum with the attached pockets may be attached to a hanger which may then be hung upon a closet rod or protrusion. This allows the pockets to be readily visible within a closet or on a wall or the like so that the user may easily assess the availability of jewelry and select an appropriate piece to be worn. The substratum is attached to the lower edge of the hanger by any appropriate means such as ties, clips, or a tube, attached to the upper edge of the substratum, which encloses the lower edge of the hanger.

The flexible nature of both the substratum and the pockets allows the invention to be folded upon itself for easy storage or transport with the jewelry still in place within the pockets. In its folded condition, very little space is wasted thereby providing a space efficient jewelry storage and transportation device. The invention cushions and protects each piece of jewelry from the hazards of travel and storage such as bumps and compression.

It is therefore an object of the present invention to provide an easily transportable jewelry box.

It is another object of the invention to provide a collapsable or foldable jewelry box.

It is yet another object of the present invention to provide a jewelry storage device which allows the user to easily see the individual pieces of jewelry stored within the pockets of the device and thereby assess what pieces of jewelry are available for use.

It is yet another object of the present invention to provide a jewelry storage device which is simple, inexpensive, and easy to manufacture.

With these objects in mind, and other objects which will become apparent hereafter, the instant invention will now be described with particular reference to the accompanying drawings.

DESCRIPTION OF THE PREFERRED EMBODIMENT

Figure 1:
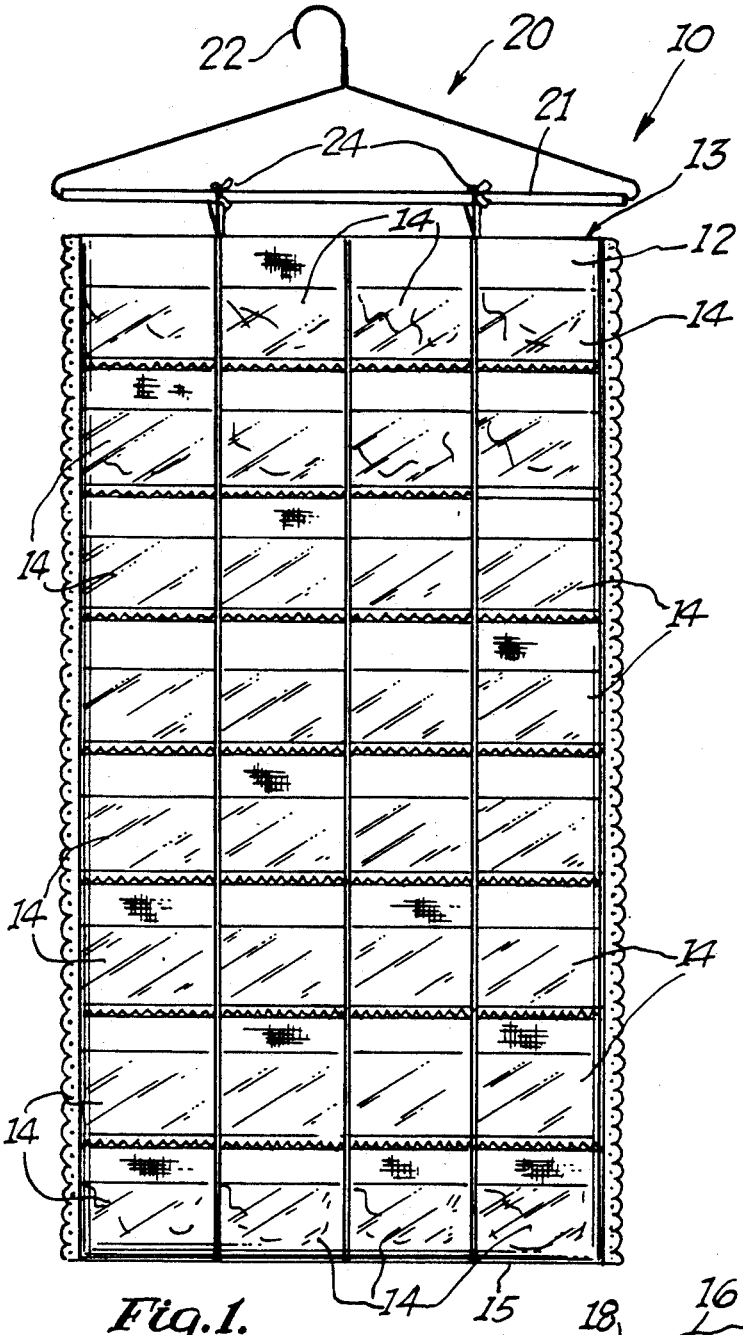
FIG. 1 shows a front elevational view of one side of the instant invention.
Figure 2:
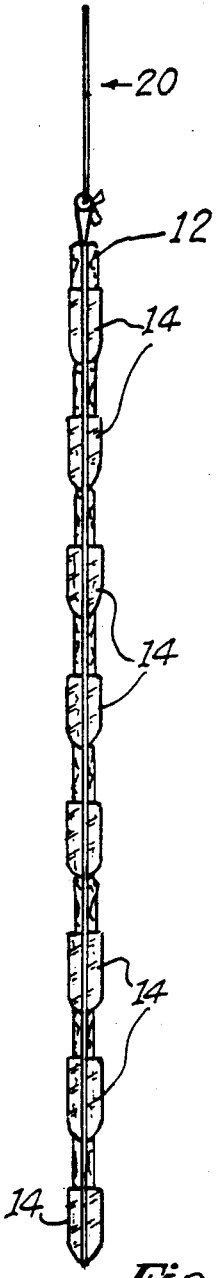
FIG. 2 shows a side elevational view of the instant invention of FIG. 1.

A front view of one side of the instant invention, generally labeled 10, is shown in FIG. 1. This view shows characteristics of the invention which are common to both sides as shall be explained later in this description.

A flexible substratum 12 having a top edge 13 is shown. In the preferred embodiment, the substratum is manufactured of a quilted, padded or matted cotton cloth material and is sewn around its edges to prevent fraying and to enhance appearance. Lace or the like may be sewn around the edges of substratum 12 as desired to enhance the appearance of the invention. The material of the substratum may be of any flexible type and may include any chosen color, print, or pattern.

Figure 3:
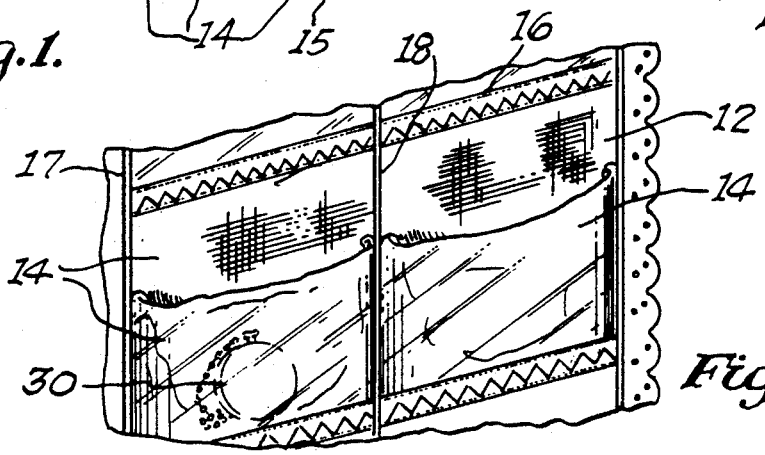
FIG. 3 is a close up perspective view of one of the pockets of the instant invention.

Pockets 14 are placed across the surface of the substratum 12. Pockets 14 are manufactured of a flexible transparent or translucent material such as plastic so that objects stored within the pockets are rendered visible through the transparent or translucent flexible material. In the preferred embodiment, the pockets 14 are manufactured of essentially rectangular strips of a flexible plastic. These flexible strips are attached to the substratum 12 by means such as sewing along the lower edge 15 and at least the sides 17 of the flexible material as shown in FIG. 3. By attaching the flexible strips along their lower edges 15 to substratum 12, a natural fold line is created. The fold lines greatly aid in compactly folding and storing of the jewelry holder when traveling. The fold lines provide uniformity in folds when folding. Thus, when folding the folds will be of equal lengths preventing overlaps.

Figure 4:
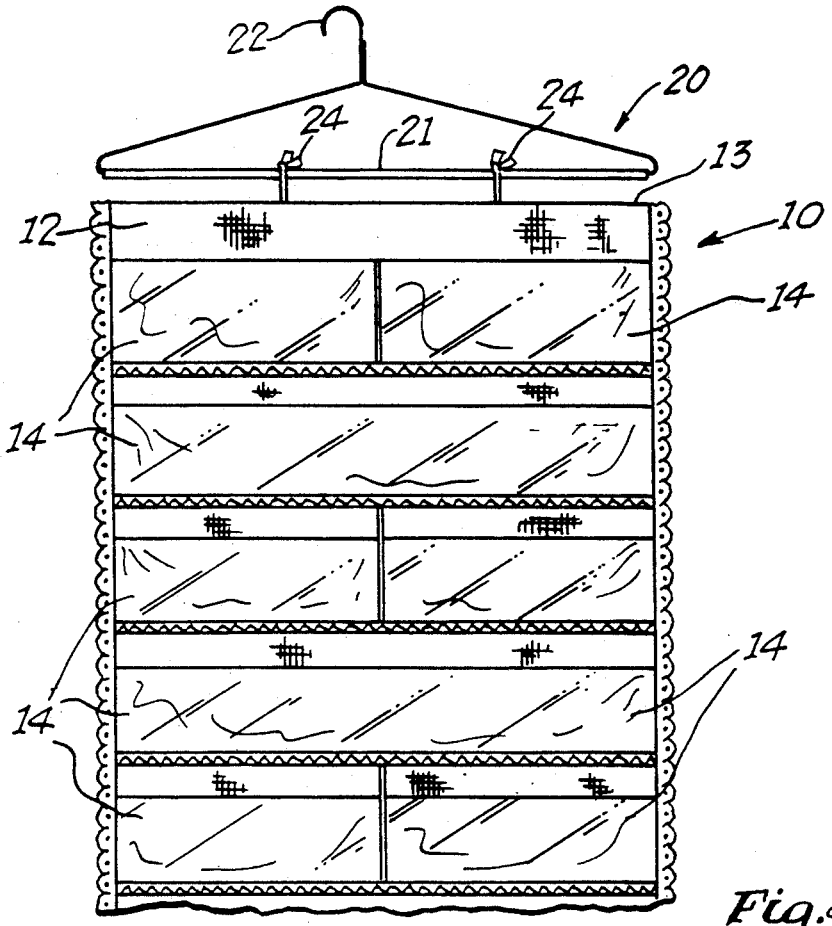
FIG. 4 is a front elevational view of the side of the instant invention opposite to that shown in FIG. 1.

In addition to the seams placed along the lower edge 15 and sides 17, additional vertical middle seams 18 may be placed between sides 17 as desired to create a plurality of pockets 14. The top edge 16 of the flexible material is not sewn, leaving an opening whereby jewelry objects 30 may be placed within pockets 14. As shown in FIG. 4, pockets 14 may be of various sizes depending on the placement and number of middle seams 18. These pockets may be arranged in pairs corresponding to left and right earrings, for example, or may include elongated pockets for storing necklaces or the like. For example, the height of the pockets might be 2" and the length of each pocket might vary from 1" to 12". These sizes are given only by way of example, and not for limitation.

In the preferred embodiment, the pockets are arranged in a matrix configuration to provide order and arrangement of the jewelry items 30. However, it is within the scope of the invention for any arrangement of pockets 14 using the teachings described herein.

Figure 6:
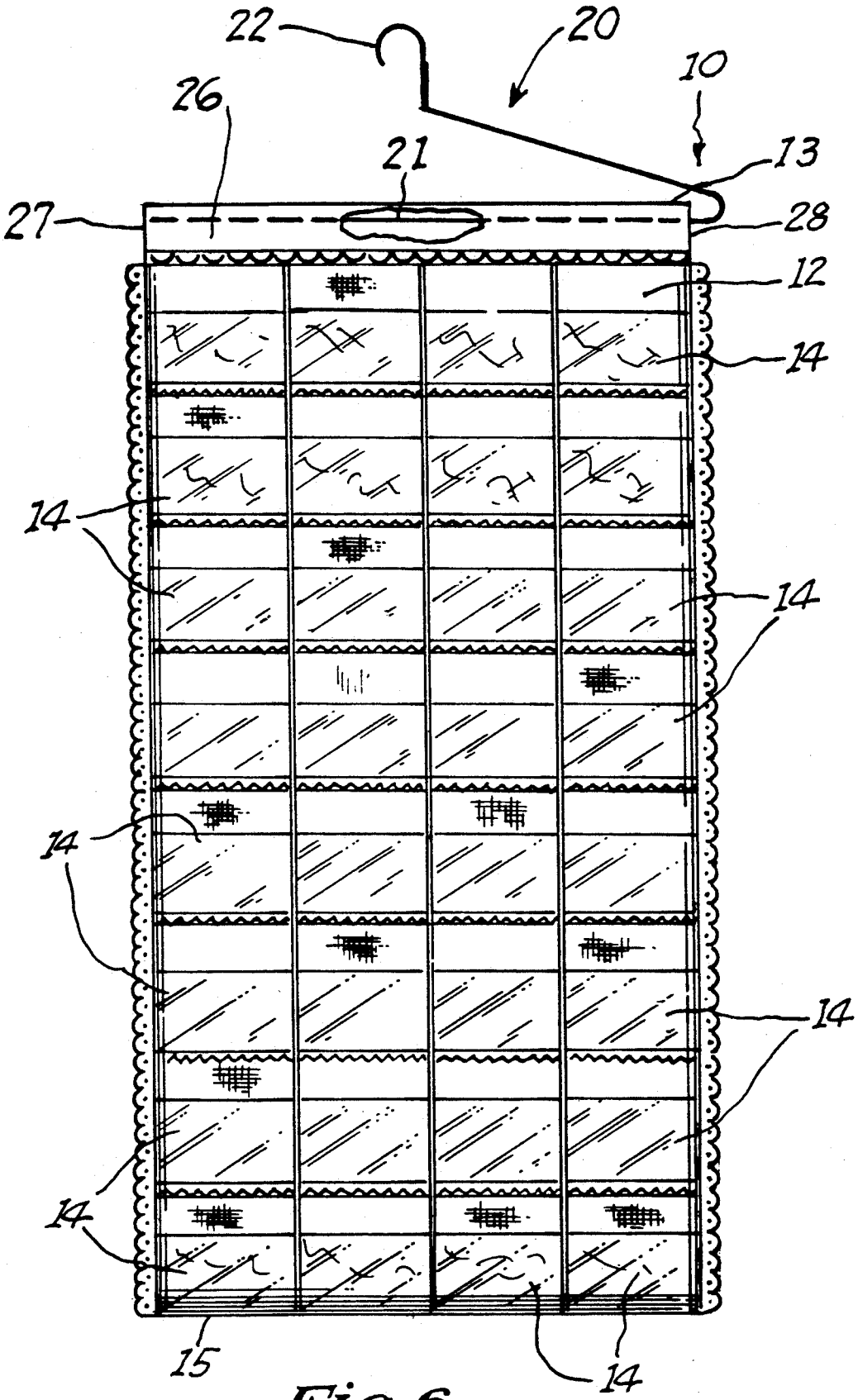
FIG. 6 is a side elevational view of the hanger and tube connection to the substratum.

A hanger 20 having a hook 22 for attachment to a closet rod or protrusion and having a lower edge 21 is provided. In the preferred embodiment, hanger 20 is of the kind commonly used to hang slacks wherein the lower edge 21 is a protrusion attached at one end only to the hook 22; the other end being free standing as shown in FIG. 6.

Figure 7:
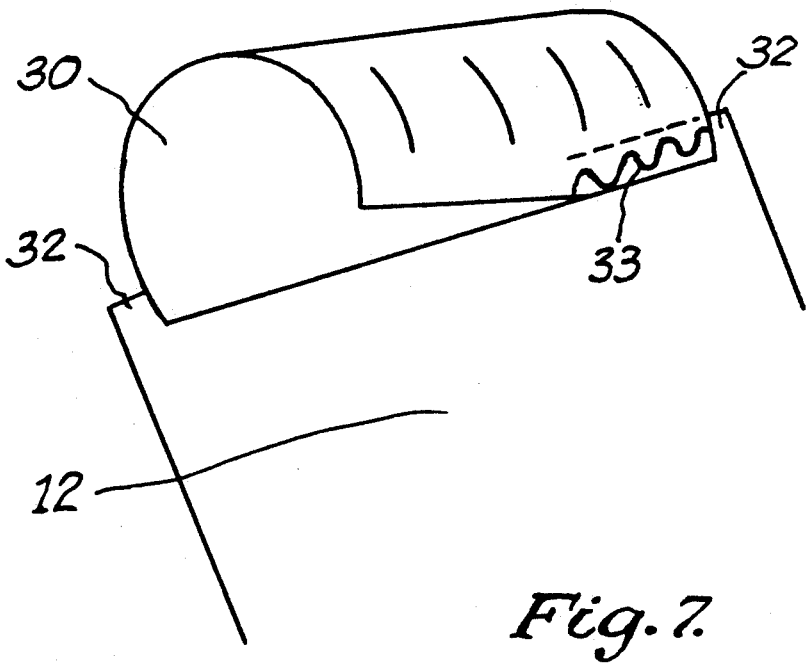
FIG. 7 is a perspective view of the tube of FIG. 6 partially sewn together.

A tube 26 is attached to substratum 12 along the top edge of substratum 12 parallel to the top edge. Tube 26 is preferably made by taking a rectangular piece 30 (FIG. 7 of a flexible material such as cloth and sewing 33 the relatively longer opposing edges together through the top edge 32 of substratum 12 thereby attaching tube 26 to the top edge of substratum 12. End 27 of tube 26 may be either open or closed as desired. To close end 27, opposing edges may be brought together and sewn closed or a roughly circular piece of flexible material such as cloth may be sewn to the edges of rectangular piece 30 to form a closed end similar in shape to the base of a cylinder. Of course, the end 28 of tube 26 opposite end 2 must be opened to receive lower edge 21 of hanger 20 in this embodiment.

The lower edge 21 of hanger 20 may be quickly and easily inserted into tube 26 through the open end 28 of tube 26. Thereafter, substratum 12 will be suspended from lower edge 21 by the interaction of the upper surface of tube 26 with lower edge 21. When it is desirable to remove lower edge 21 from tube 26, for example when traveling so as to permit compact storage of substratum 12, the lower edge 21 is removed from tube 26 whereupon substratum 12 may be folded or rolled up into a compact configuration.

Figure 8:
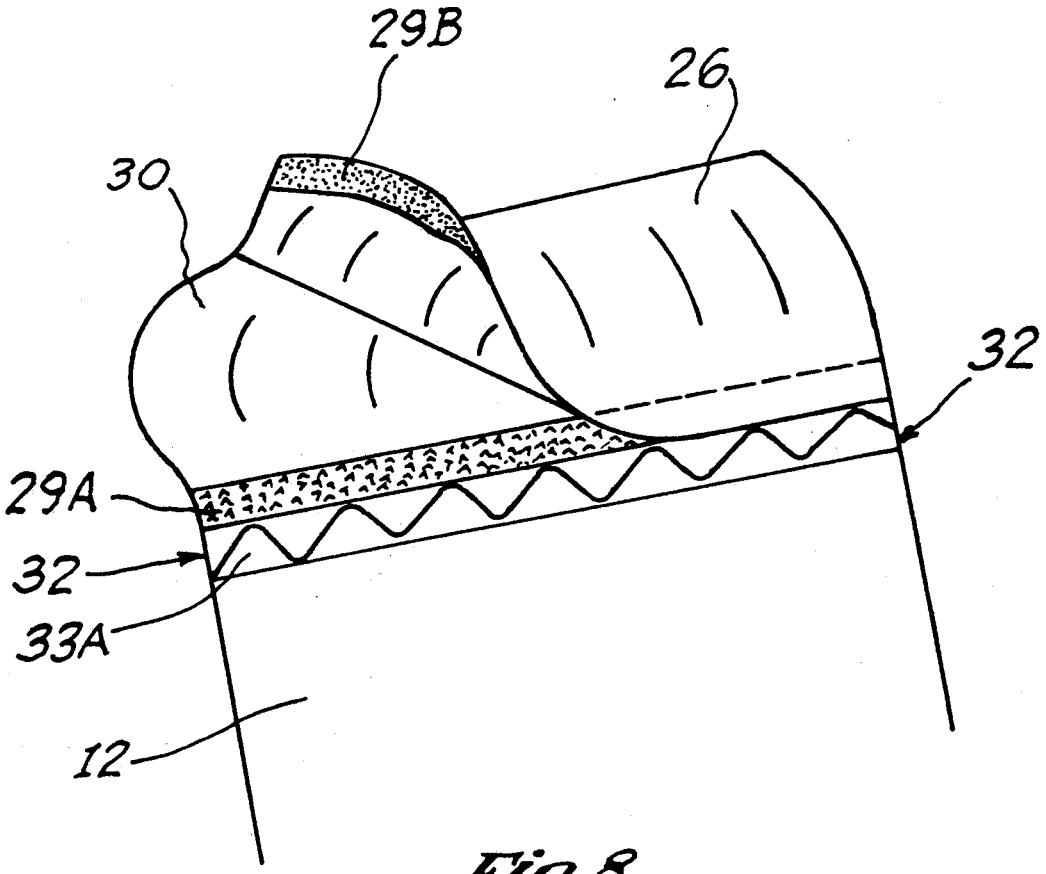
FIG. 8 is a perspective view of the instant invention showing an alternative embodiment for the hanger and tube connection to the substratum.

In an alternate embodiment, shown in FIG. 8, the tube 26, instead of being permanently joined to form a tube by sewing opposing relatively longer edges, is instead joined by the interaction of a hook and loop fastening system, such as that sold under the trademark VELCRO, along opposing relatively longer edges of the rectangular cloth piece 30 which makes up tube 26. In this embodiment, one edge of the relatively longer edge of the rectangular cloth piece is sewn to the top edge of substratum 12. Immediately above this sewing contact 33A, a strip 29A of either hook or loop fastener, is attached parallel to the top edge of substratum 12. Located along the top edge of rectangular piece 30 is a strip 29B of the corresponding respective loop or hook fastening system. In this embodiment, when it is desired to place tube 26 around lower edge 21 of hanger 20, the rectangular piece 30 is placed around lower edge 21 and corresponding strips 29A, B of hook and loop fastening systems are brought together thereby forming a tube. In this embodiment, lower edge 21 may be of the slacks type as show in FIG. 6 or it may be of the conventional type as shown in FIG. 1.

Although hook and loop fasteners are the preferred way of joining opposing relatively longer edges of rectangular piece 30 to form tube 26, and other means of removably joining these relatively longer edges is within the scope of the invention. Exemplary of these alternate means of joining are snaps, hooks, buttons, zippers or ties. In addition, instead of a single tube 26 extending across the top edge of substratum 12, a plurality of tubes 26 could be placed along this top edge to receive the lower edge 21 of hanger 20.

In an alternate embodiment, substratum 12 is attached to hanger 20 along lower edge 21 by means of flexible ties 24 which are integrally attached to the top edge of substratum 12. In this embodiment, these ties 24 are made of cloth strips, sewn along their edges. The ties 24 are then tied around the lower edge 21 of hanger 20. Although this embodiment uses ties 24 to attach substratum 12 to hanger 20, any means for attaching substratum 12 to hanger 20 without the use of a tube 26, such as clips or hooks is within the scope of this invention. The advantage of using ties, clips, or hooks is that these means for attachment also permit easy removal of the hanger for travel.

Figure 5:
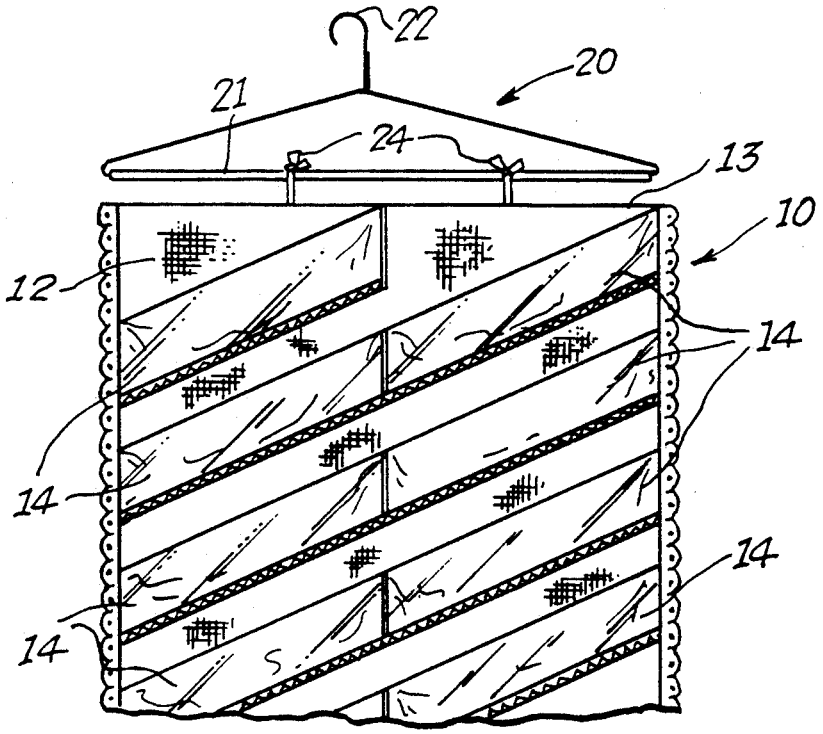
FIG. 5 shows a front elevational view of one side of an alternate embodiment of the invention.

FIG. 5 shows an alternate embodiment of the present invention where like reference numbers represent like elements as described above. In FIG. 5, pockets 14 are placed on substratum 12 in a slanting, rather than horizontal configuration. In this embodiment, the side seams 17 and middle seams 18 are vertical while the seams along the bottom edge 15 slant from one side of the substratum to another. Additional seams may be placed as needed to create pockets out of the triangular regions near the edges of some of the slanting flexible pocket material.

While the present invention has been described in what is the preferred embodiment, it is to be understood that this description is by way of example only, and not by way of limitation. Additional changes or modifications obvious to one skilled in the related art are still within the scope of this invention.

What is claimed is:

1. A collapsable and foldable device for arranging and storing jewelry comprising:

a) a rectangular, flexible substratum having a length and height, said substratum having a top edge and two opposite substantially planar surfaces;

b) a first plurality of flexible, transparent members attached to a first of said two opposite substantially planar surfaces, each of said first plurality of flexible members having a plurality of side edges and a top edge and a bottom edge, each of said first plurality of flexible members attached to said first substantially planar surface along their respective plurality of side edges and respective bottom edge to form a first plurality of pockets on said first substantially planar surface and to create a natural fold line at the bottom edge for aiding in compactly folding and storing said device, whereby said top edge of each said first plurality of flexible members is unattached to said first substantially planar surface to provide access to a respective pocket of said first plurality of pockets;

c) a second plurality of flexible, transparent members attached to a second of said tow opposite substantially planar surfaces, each of said second plurality of flexible members having a plurality of side edges and a top edge and a bottom edge, each of said second plurality of flexible members attached to said second substantially planar surface along their respective plurality of side edges and respective bottom edge to form a second plurality of pockets on said second substantially planar surface and to create a natural fold line at the bottom edge for aiding in compactly folding and storing said device, whereby said top edge of each said second plurality of flexible members is unattached to said second substantially planar surface to provide access to a respective pocket of said second plurality of pockets; and d) means for attaching said substratum to the lower edge of a hanger comprising at least one tube attached along said top edge of said substratum, said tube enclosing said lower edge of said hanger thereby supporting said substratum from said lower edge of said hanger through said tube.

2. The device of claim 1 wherein said tube is formed from a substantially rectangular piece of flexible material, said flexible material having a plurality of edges, a first and second edge of said plurality of edges being substantially parallel to each other, said first and second edge being joined to form said tube for enclosing said lower edge of said hanger.

3. The device of claim 2 wherein said relatively longer edges of said rectangular piece are removably joined to form said tube.

4. The device of claim 3 wherein said relatively longer edges of said rectangular piece are removably joined through the interaction of a hook and loop fastening system attached along opposing edges of said relatively longer edges so that when the respective hooks along one said longer edge are brought into contact with the corresponding loops along the corresponding said longer edge, said longer edges are joined to form said tube by the interaction of said hooks with said loops.

5. The device of claim 3 wherein said relatively longer edges of said rectangular piece are removably joined through the interaction of fastening devices chosen from the group consisting of snaps, hooks, buttons, zippers, and ties so that when the respective said longer edges are brought together, said longer edges will be joined to form said tube.

6. The device of claim 2 wherein said relatively longer edges of said rectangular piece are permanently joined to form said tube.

7. The device of claim 1 wherein said plurality of flexible pockets are arranged in a matrix configuration.

8. The device of claim 1 wherein said first plurality of flexible members are sewn to said first substantially planar surface at said plurality of side edges and said bottom edge to form said first plurality of pockets.

9. The device of claim 1 wherein said first and second plurality of pockets are substantially rectangular shaped.

10. The device of claim 1 wherein said substratum is manufactured of a quilted cloth material.

11. The device of claim 1 wherein said second plurality of flexible members are sewn to said second substantially planar surface at said plurality of side edges and said bottom edge to form said second plurality of pockets.

12. The device of claim 1, wherein said first and second plurality of flexible members have various heights and lengths.

13. The device of claim 1, wherein said first and second plurality of flexible members have various heights and a length substantially equal to said length of the substratum.

14. The device of claim 13, wherein said first and second plurality of flexible members are further sewn at various locations of said length of said flexible members to form compartments within said first and second plurality of pockets.

* * * * *